US007153158B1

(12) United States Patent
Lee

(10) Patent No.: US 7,153,158 B1
(45) Date of Patent: Dec. 26, 2006

(54) STACKED MODULE CONNECTOR

(75) Inventor: Ming-Chih Lee, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/485,881

(22) Filed: Jul. 13, 2006

(30) Foreign Application Priority Data

Jul. 13, 2005 (CN) ..... 2005 2 0073720

(51) Int. Cl.
*H01R 13/66* (2006.01)

(52) U.S. Cl. ..... 439/541.5; 439/620.01; 439/620.11; 439/620.17; 439/620.23; 439/676

(58) Field of Classification Search ..... 439/541.5, 439/620.11, 620.17, 620.21, 620.23, 620.01, 439/620.06
See application file for complete search history.

(56) References Cited

U.S. PATENT DOCUMENTS 6,428,361 B1 8/2002 Imschweiler et al.
6,773,302 B1 8/2004 Gutierrez et al.
6,872,098 B1 * 3/2005 Wojtacki et al. ..... 439/676
6,976,877 B1 * 12/2005 Lien ..... 439/620.01
7,025,635 B1 * 4/2006 Chang ..... 439/620.07

FOREIGN PATENT DOCUMENTS

CN 2629261 7/2004

* cited by examiner

*Primary Examiner*—Tho D. Ta
(74) *Attorney, Agent, or Firm*—Wei Te Chung

(57) ABSTRACT

A modular connector for electrically connecting a modular plug to a mother board includes an insulative housing having a vertical front mating face and an electrical module mounted in the housing. The electrical module includes a front PCB parallel the mating face, two mutual parallel second electric circuit boards perpendicularly connecting to the front PCB, and a number of magnetic coils directly mounted on the rear PCBs.

19 Claims, 14 Drawing Sheets

STACKED MODULE CONNECTOR

BACKGROUND OF THE INVENTION

1. Field of the Invention

The present invention relates to a modular connector used for electrically connecting a modular plug to a mother board, and more particularly, relates to a 2XN-port stacked modular connector employing therein a plurality of electrical elements.

2. Description of the Prior Art

A conventional 2X1 modular connector is disclosed in Chinese Patent document No. CN 2629261 Y issued on Oct. 10, 1995. The 2X1 modular connector includes an insulative housing, an electrical module received in the housing and a shield covering the housing. The electrical module includes a front vertical PCB(printed circuit boards) defining a front side and a back side opposite to the front side, a mating module mounted on the front side of the front PCB, a first magnetic box having a first plurality magnetic coils received therein, a second magnetic box having a second plurality of magnetic coils received therein and two parallel rear PCBs. The second magnetic box forms a corresponding number of grooves for positioning down-leads of said second plurality of magnetic coils and through-hole mounted to the rear PCBs and so fastening the rear PCBs together. The structure of the electrical module disclosed here is much too complicated and takes too much space. Further more, there is no means for steadily fastening the front PCB and the rear PCBs.

Hence, an improved stacked modular connector is needed to solve the above problems.

BRIEF SUMMARY OF THE INVENTION

One object of the present invention is to provide a 2XN electrical modular jack having at least one 2X1 electrical modules in simplified and miniaturized structure to provide enough space for receiving electrical components.

A modular connector used for electrically connecting modular plugs to a mother board is provided. The modular connector comprises an insulative housing and at least one electrical modules received in the housing. Each of the at least one electrical modules comprises a front PCB, a mating module mounted on said front PCB, two mutually parallel second PCBs perpendicularly fastened to two opposite lateral side edges of said front PCB to define a receiving slot between the rear PCBs, and a plurality of electrical modules directly mounted on interior faces of said rear PCBs.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
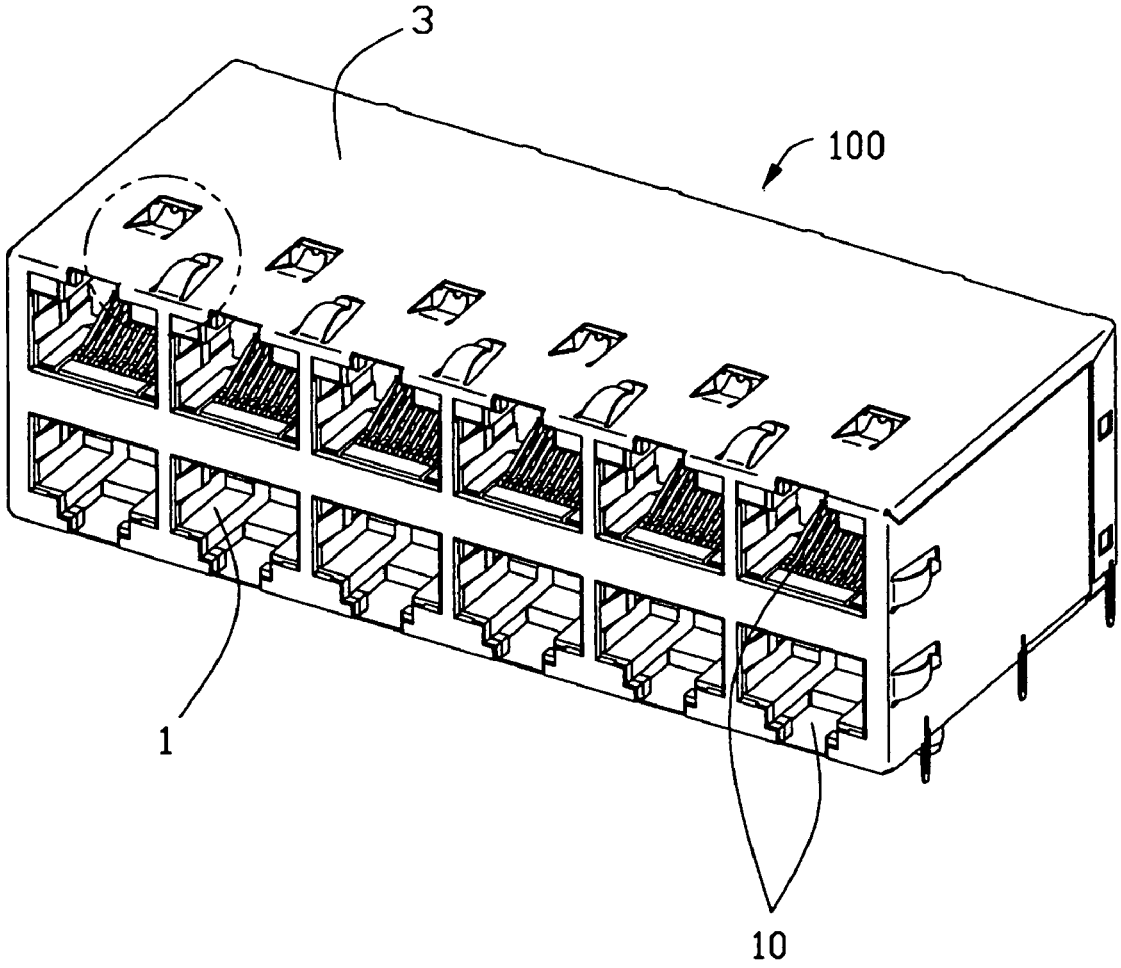
FIG. 1 is a perspective view of a 2X6-port modular connector according to the present invention.

Reference will now be made to the drawing figures to describe the present invention in detail.

Figure 2:
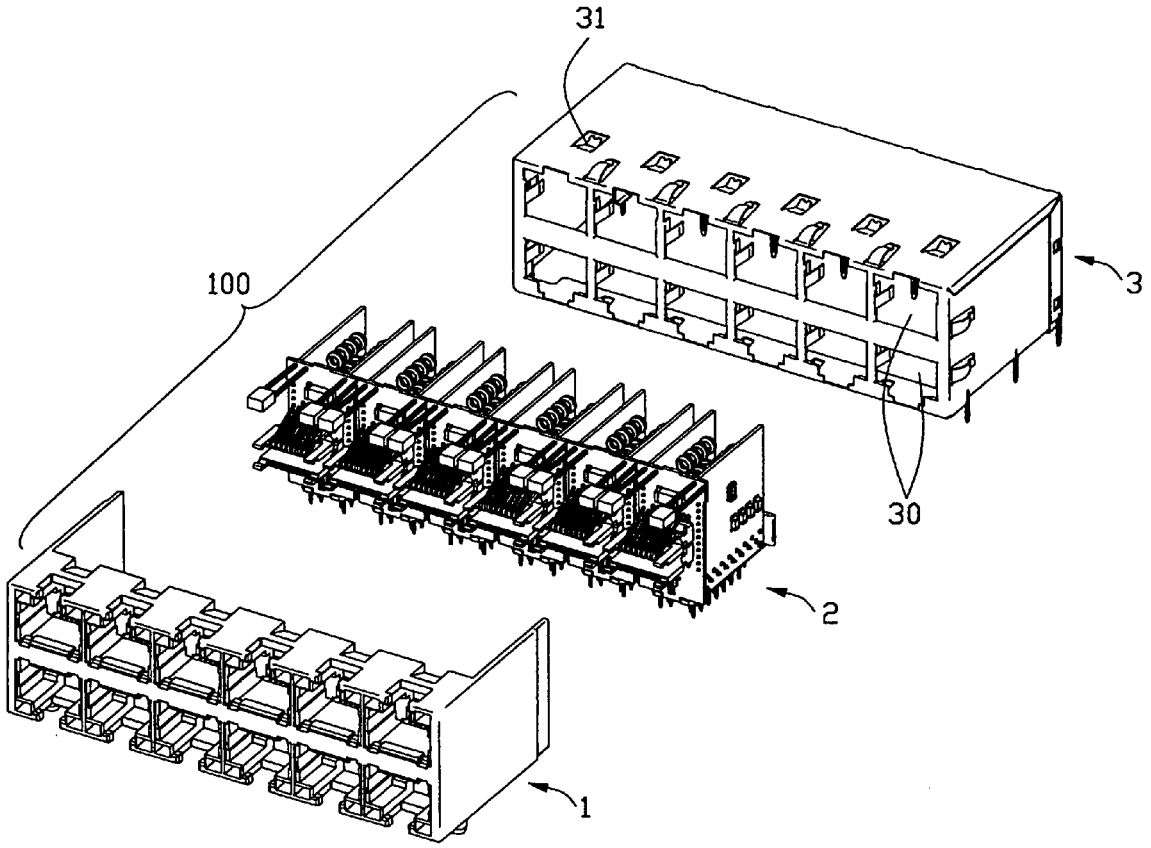
FIG. 2 is a perspective view of subassemblies of the 2X6-port modular connector shown in FIG. 1.

FIG. 1 shows a 2X6-port modular connector 100 to be mounted on a mother board (not shown) according to the present invention and FIG. 2 shows the subassemblies of the 2X6-port modular connector 100. The modular connector 100 defines a front mating interface having 2X6 ports for receiving 12 modular plugs and includes an insulative housing 1, six 2X1 electrical modules received in the housing 1 and a shielding 3 covering the housing 1.

Figure 3:
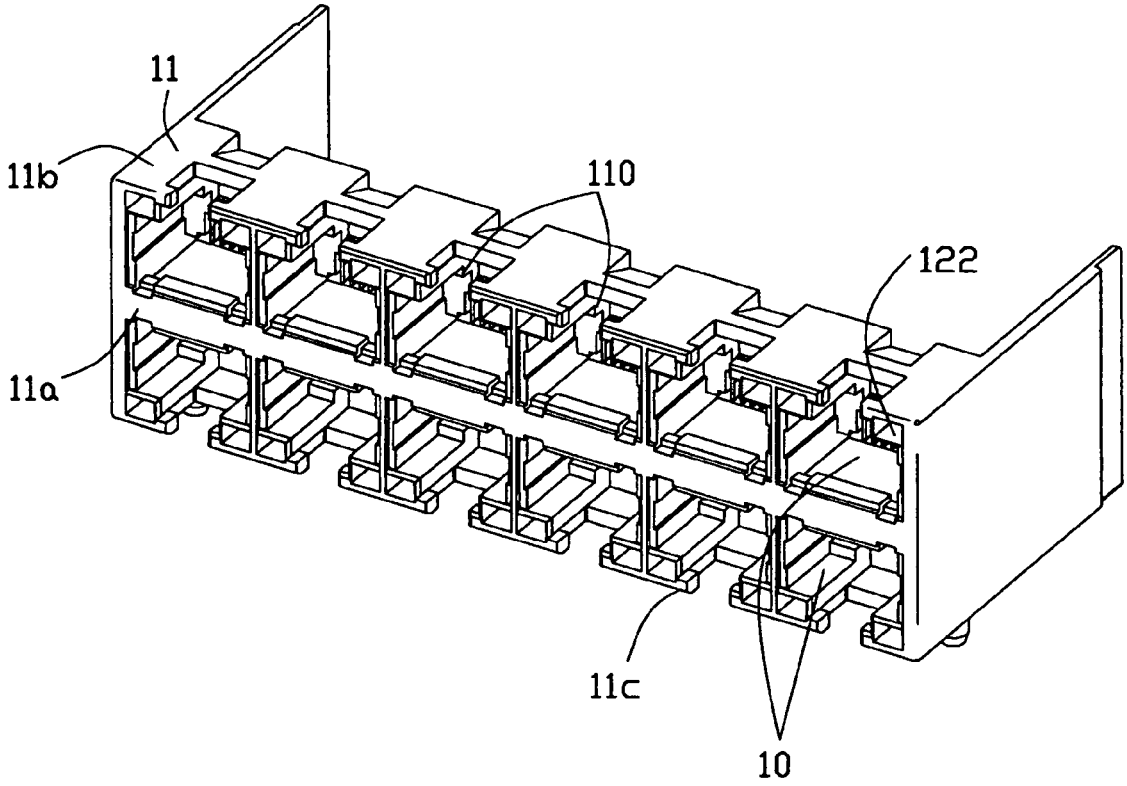
FIG. 3 is a perspective view of a housing shown in FIG. 2.
Figure 4:
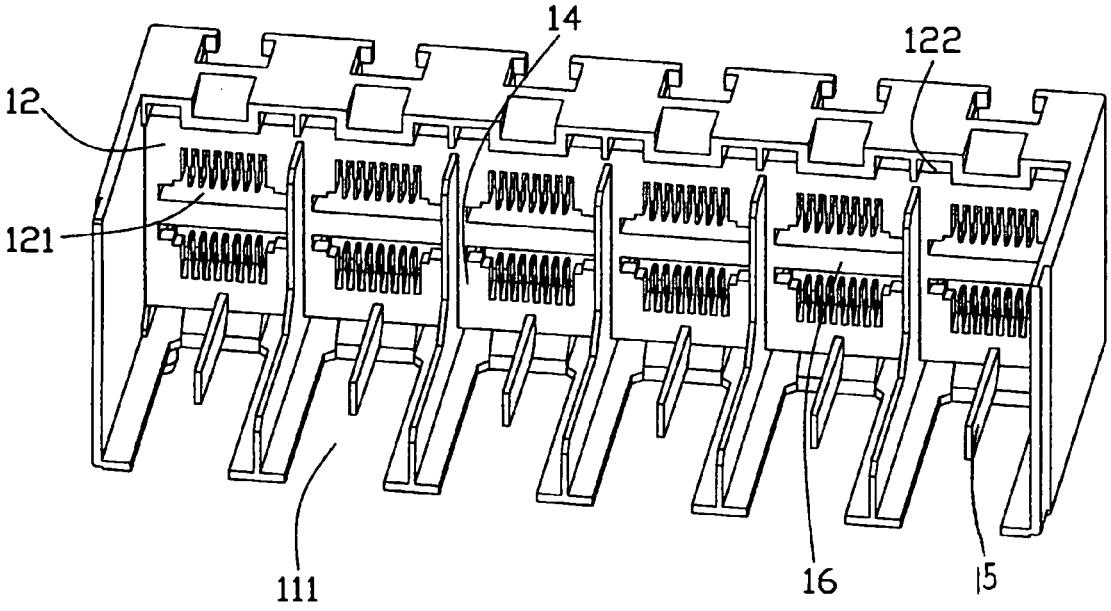
FIG. 4 is another perspective view of the housing shown in FIG. 3.

Referring to FIGS. 3,4, the housing 1 defines a vertical front mating face 11*a* and six pairs of stacked cavities 10 arranged in two horizontal lines. The housing 1 forms a divisional wall 16, a number of lateral walls 11 extending backwardly from the mating face 11 and a center wall 12 extending vertically to define the cavities 10. The lateral walls 11 extend beyond the center wall 12 to define six back spaces 14. Each of the back spaces 14 includes a pair of communicating slots 121 cutting through the center wall 12 and so communicates respective pair of cavities 10. The center wall 12 further forms a guiding board 15 extending backwardly corresponding each back space 14. The lateral walls 11 includes a top wall 11*b* defining six pairs of eyelets 110 horizontally extending there through and a bottom wall 11*c* defining six slots 111 corresponding to each back space 14.

Figure 5:
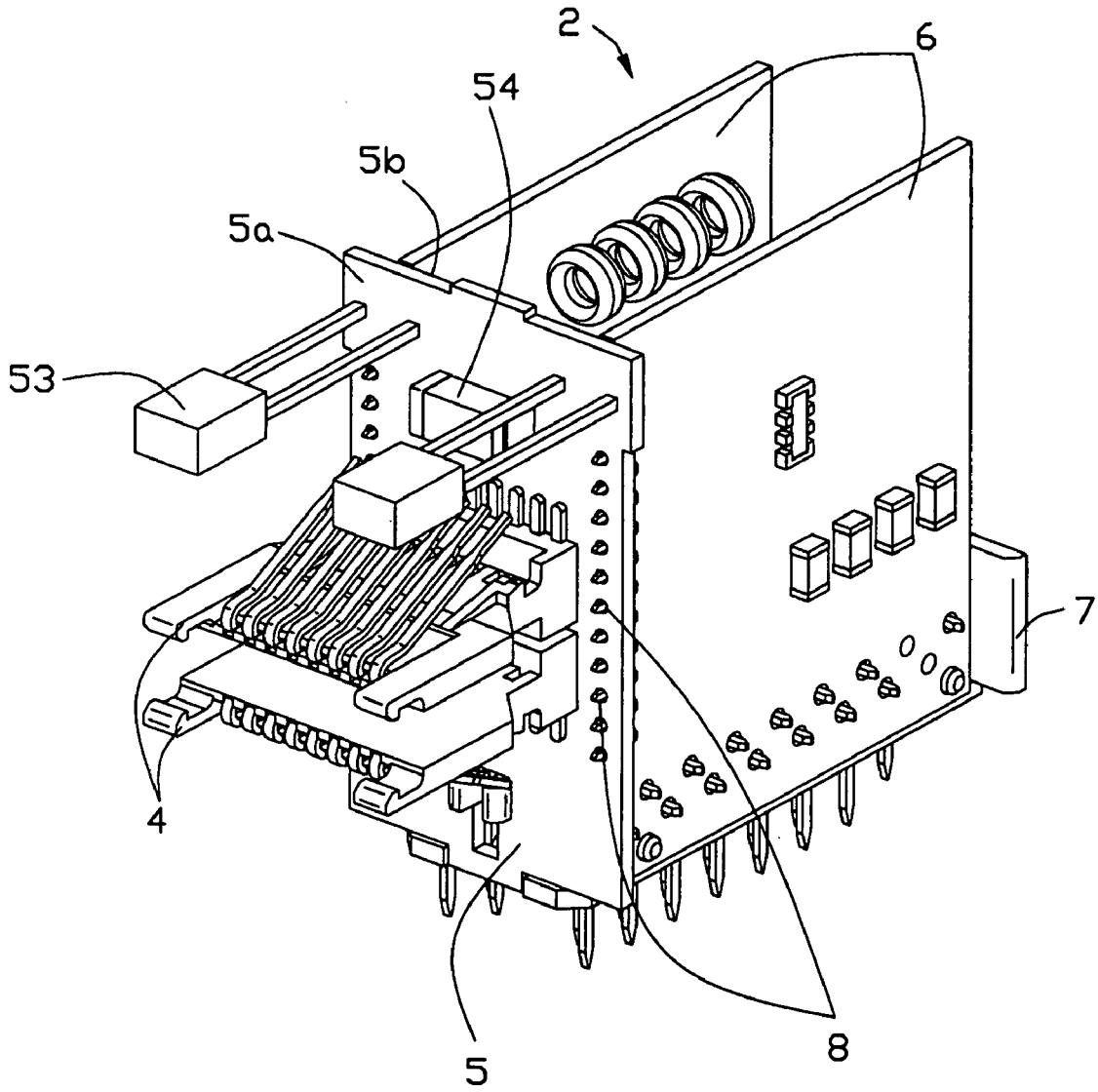
FIG. 5 is a perspective view of an electrical module shown in FIG. 2.
Figure 6:
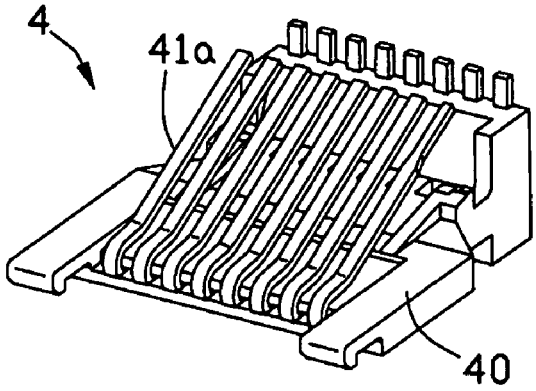
FIG. 6 is a perspective view of an mating module for making the electrical module shown in FIG. 5.
Figure 7:
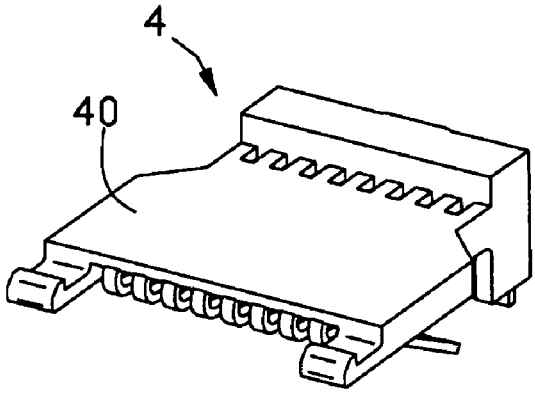
FIG. 7 is another perspective view of the mating module shown in FIG. 6.
Figure 8:
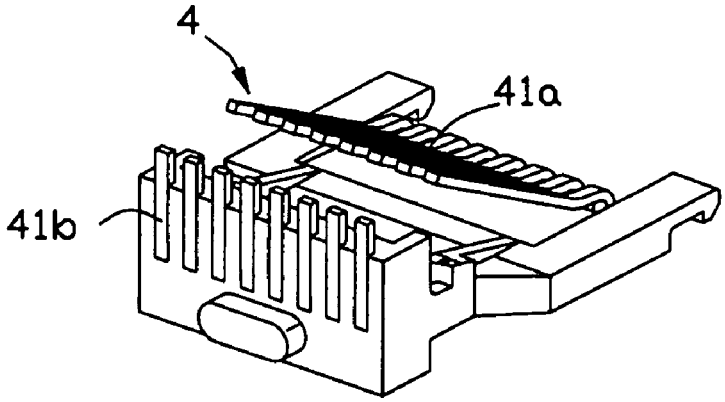
FIG. 8 is still another perspective view of the mating module shown in FIG. 6.
Figure 9:
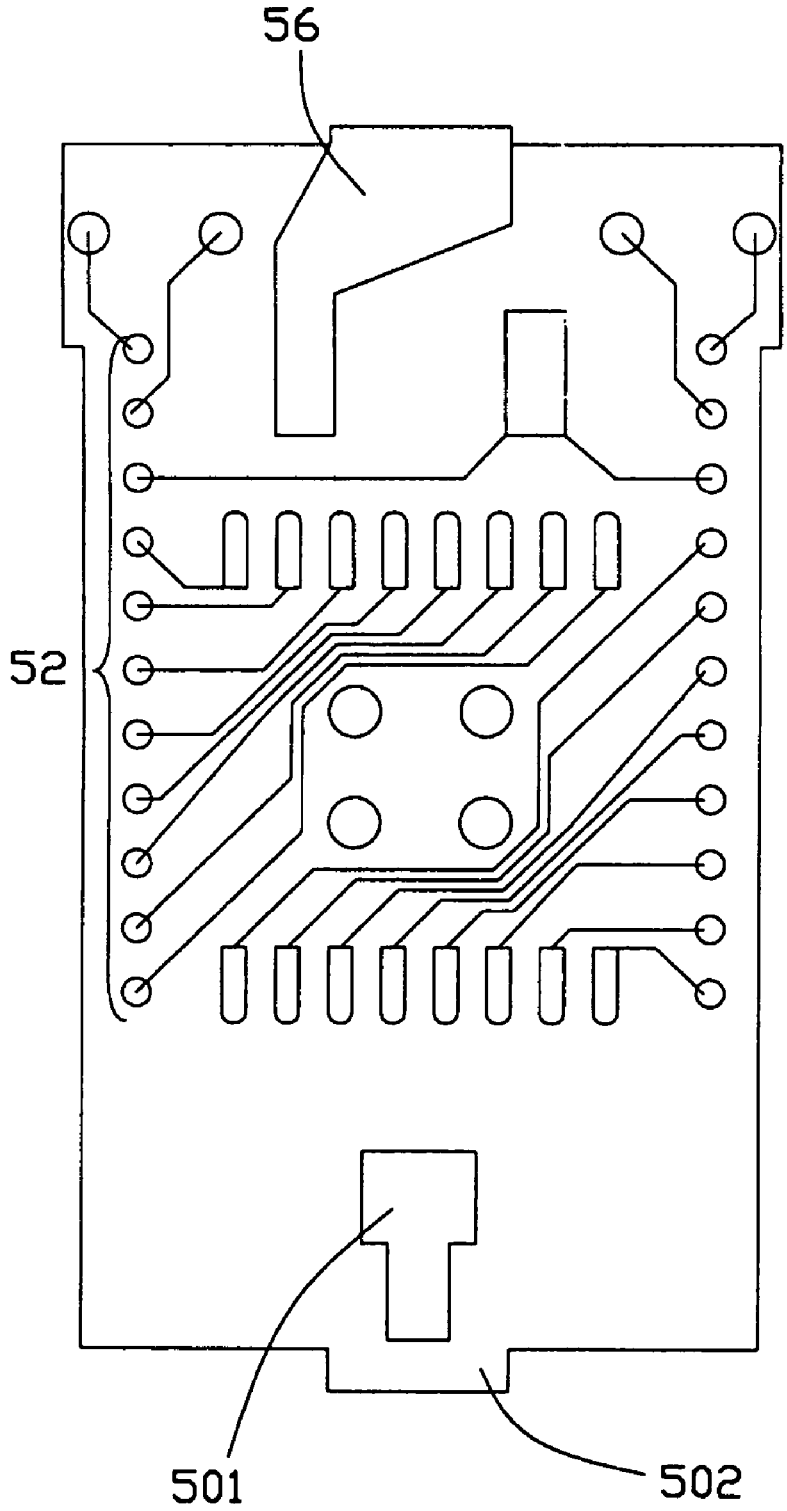
FIG. 9 is a front view of an front PCB for making the electrical module shown in FIG. 5.

FIG. 5 shows a 2X1 electrical module 2. The electrical module includes a front PCB module (not labeled), two rear PCB modules (not labeled) and a footer module 7 (shown in FIG. 12).

Referring to FIGS. 5–9, the front PCB module includes a vertical rectangular front PCB 5, a high voltage capacitor 54, two LEDs 53 and two mating modules 4. Each of the mating modules 4 includes a L-shaped first insulative body 40 and a number of mating contacts 41 for mating with a mating module plug (not shown). Each of the mating contacts 41 includes a solder portion 41*b* SMT soldered on the front PCB 5, a securing portion (not shown) buried in the first insulative body 40 extending forwardly from the solder portion 41*b* and a mating portion 41*a* extending backwardly from a front end of the securing portion. The high voltage capacitor 54, two LED 53 and two mating modules 4 are all mounted on a front side 5*a* of the front PCB 5 and the two mating modules 4 are symmetrically arranged with the mating portion 41*b* disposed outward. The front PCB 5 forms an upper horizontal edge, a lower horizontal edge and two vertical edges. The upper edge forms a contacting area 56 for electrically connected to the shield 3 and the LEDs 53 are arranged thereon symmetrically with regard to the contacting area 56. The lower edge forms a positioning tab 502 and a T-shaped through hole 501 for mating with the footer module 7. Each of the two vertical edges defines a vertical row of through holes 52 respectively electrically connected to the LEDs 53, the high voltage capacitor 54 and the mating contacts 41 of the mating modules 4.

Figure 10:
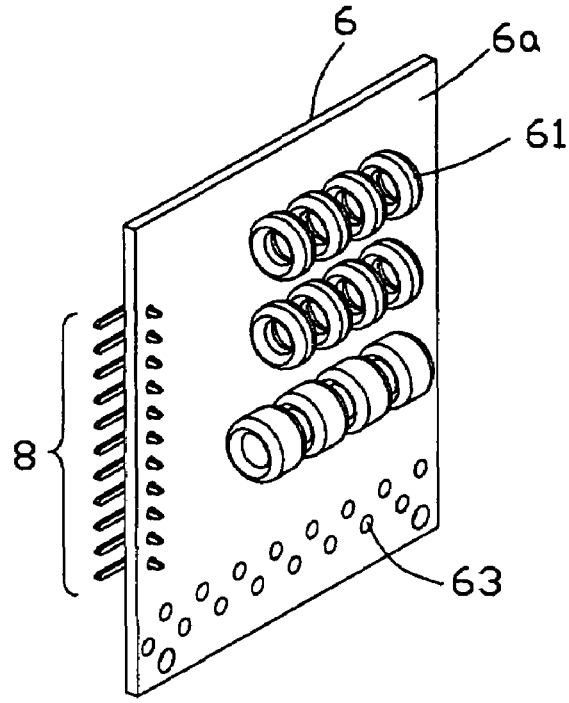
FIG. 10 is a perspective view of a rear PCB module for making the electrical module shown in FIG. 5.
Figure 11:
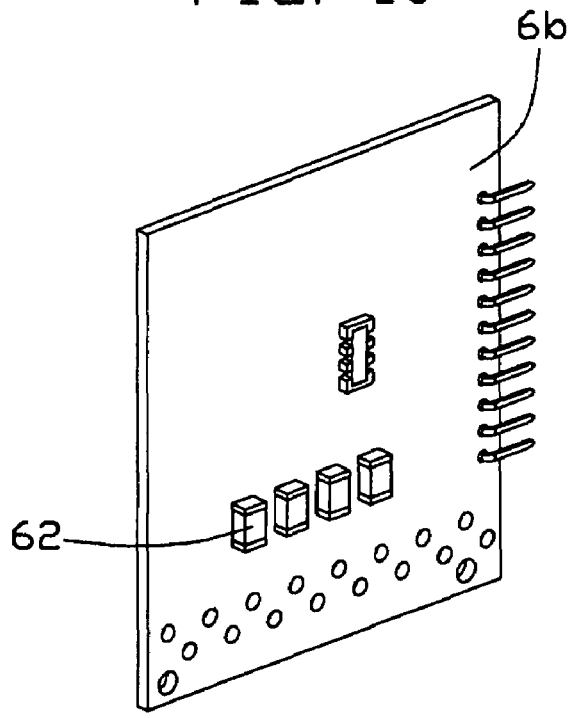
FIG. 11 is another perspective view of the rear PCB module shown in FIG. 10.

Reference to FIGS. 10, 11, each of the rear PCB modules includes a rectangular rear PCBs 6, a row of right-angled pins 8 and a plurality of electrical components. Two rear PCBs 6 of the electrical module 2 are used to be parallelly and vertically arranged with a distance therebetween less than a width of the front PCB 5 (as shown in FIG. 5) and so forms a pair of interior sides 6*a* and a pair of exterior sides 6*b*. The electrical components include a number of magnetic coils 61 mounted on the interior sides 6*a* of the rear PCBs 6, a number of resistors 62 and a number of capacitors (not labeled) on the exterior sides 6*b* of the rear PCBs 6. Each of the right-angled pins 8 is through-hole mounted along a vertical edge of the rear PCB 6 and has an end 81 extending forwardly for mating with the front PCB. The rear PCB 6 further forms a lower edge defining two rows of through holes 63 for mating with said footer module 7.

Figure 12:
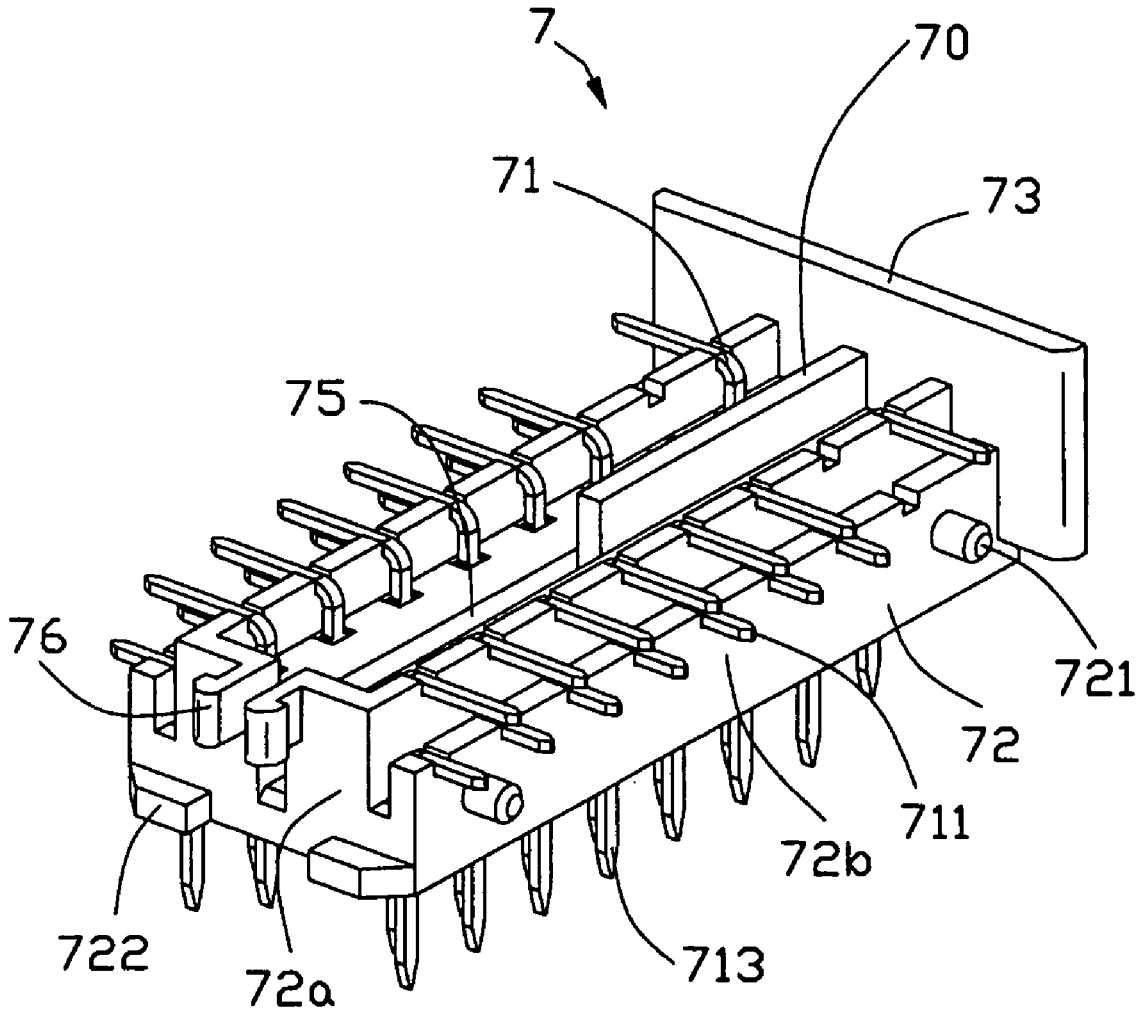
FIG. 12 is a perspective view of a footer module for making the electrical module shown in FIG. 5.
Figure 13:
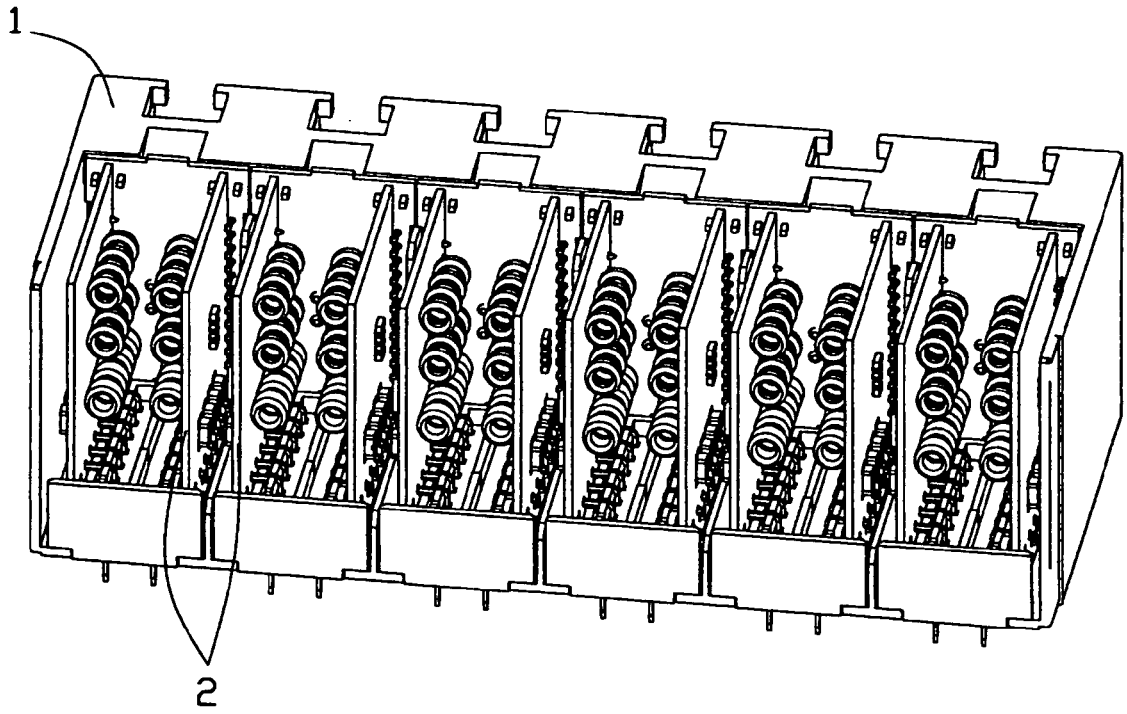
FIG. 13 is a perspective view of a subassembly with all electrical modules received in the housing shown in FIG. 2.
Figure 14:
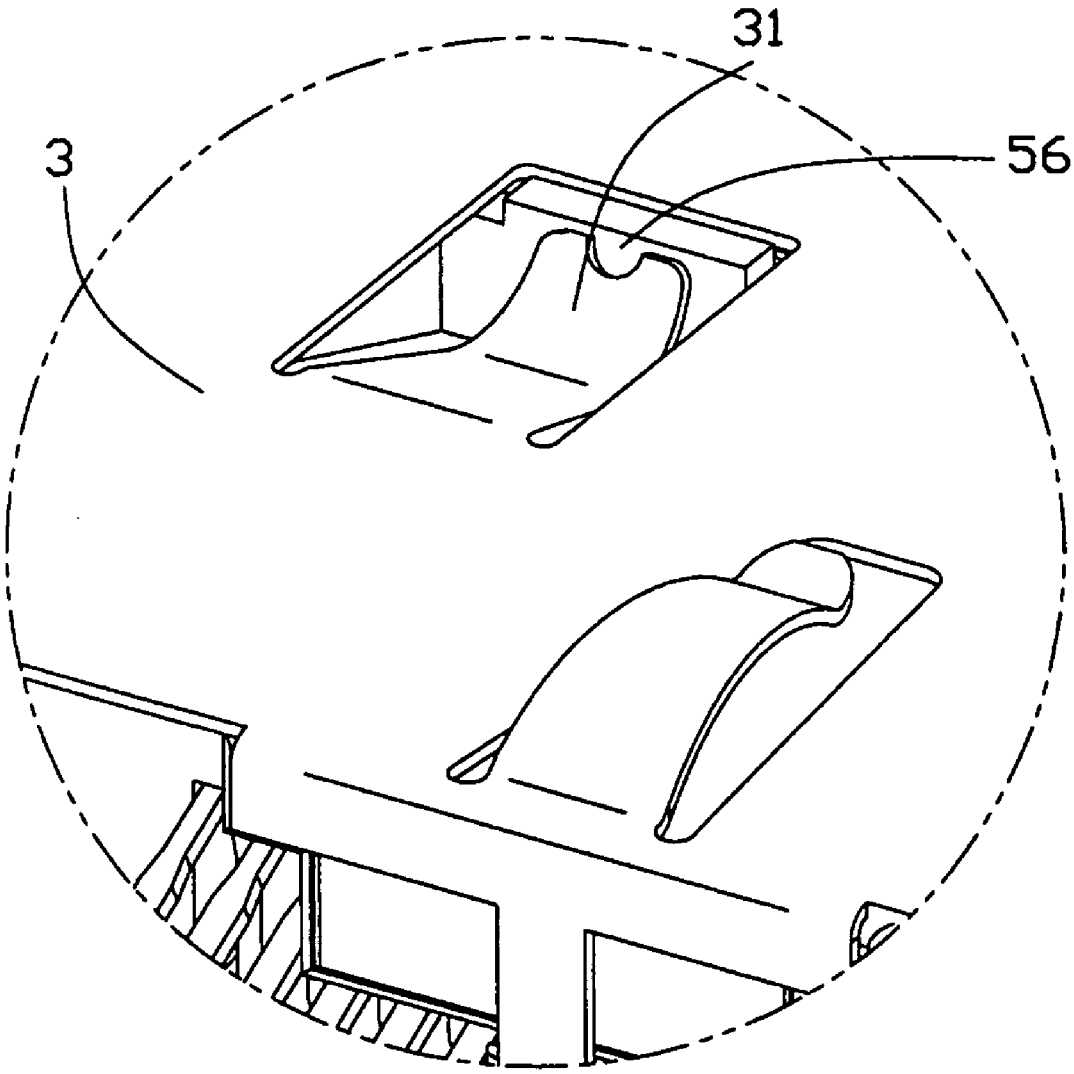
FIG. 14 is a scaled view of a circled part of the 2X6-port modular connector shown in FIG. 1.

Reference to FIG. 12, the footer module 7 includes a second insulative body 70 and four rows of right-angle terminals 71. The second insulative body 70 forms a vertical rear wall 73 and a main body 72 extending forwardly. The main body 72 defines a vertical end face 72*a* and a middle guiding slot 75 extending through the end face 72*a* of the main body 72. The end face 72*a* forms a pair of latches 76 symmetrical to each other on two sides of the guiding slot 75 for mating with the guiding board 15 of the housing 1 and a pair of positioning protrusions 722 for mating with the tab 502 of the front PCB 5. The main body 72 further defines two opposite vertical sides 72*b* perpendicular to the rear wall 73 and a pair of guiding posts 721 extending there from. Each of the right-angle terminals 71 forms a first pinhead 711 extending beyond the vertical sides 72*b* for mating with through holes 63 of the rear PCBs 6 and a second pinhead 713 extending perpendicularly to the first pinhead 711 beyond a bottom face of the main body 72.

Reference to FIG. 2, the shield 3 forms a cage with 2X6 opens 30 in corresponding to cavities 10 of the housing 1. An upper wall of the shield 3 forms six spring cantilevers 31 extending inwardly for connecting the contacting areas 56 of the front PCBs 5.

In process of assembly of the electrical module connector 100, firstly, the two rear PCB modules are respectively aligned to the footer module 7 by the rear wall 73 and the pair of guiding posts 721, and then are pushed onto the opposite vertical sides 72*b* of the second insulative body 70 along the rear wall 73 with the first pinheads 711 getting through the holes 63 of the rear PCBs 6. Secondly, the first pinheads 711 are soldered in the holes 63 of the rear PCBs 6 so that the rear PCB modules are pegged together by the footer module 7 to form a rear module. Thirdly, with the pair of positioning protrusions 722 of the footer module 7 bestriding over the positioning tab 502 of the front PCB module, the latches 76 of the footer module 7 inserted into the T-shaped through hole 501 of the front PCB 5 and latching thereon, the ends 81 of the right-angle pins 8 inserted through the vertical rows of through holes 52 of the front PCB 5, the subassembly from the second step is positioned in place onto the front PCB module. Fourthly, the ends 81 of the right-angle pins 8 are soldered so that the assembly of the electrical module 2 is completed and the right-angle pins 8 are respectively electrically connected to the mating contacts 41, the LEDs 53 and the high voltage capacitor 54. Fifthly, the electrical module 2 is inserted into the back space 14 of the housing 1 under the guiding of the guiding board 15. When the electrical module 2 is positioned in place, the pair of mating modules 4 respectively extend into corresponding cavities 10 for mating with the mating module plugs, the LEDs 53 are received in corresponding eyelets 122 of the housing 1 and the second pinheads 713 are disposed in corresponding slot 111 extending beyond the bottom wall 11*b* for connecting to the main PCB. After repeating the first-fifth steps five times, the shield 3 is at last coated over the housing 1, when the spring cantilevers 31 of the electrical modules 4 abut the contacting areas 56 of the front PCB 5 and so electrically connect the front PCB 5 to the shield 3.

Figure 15:
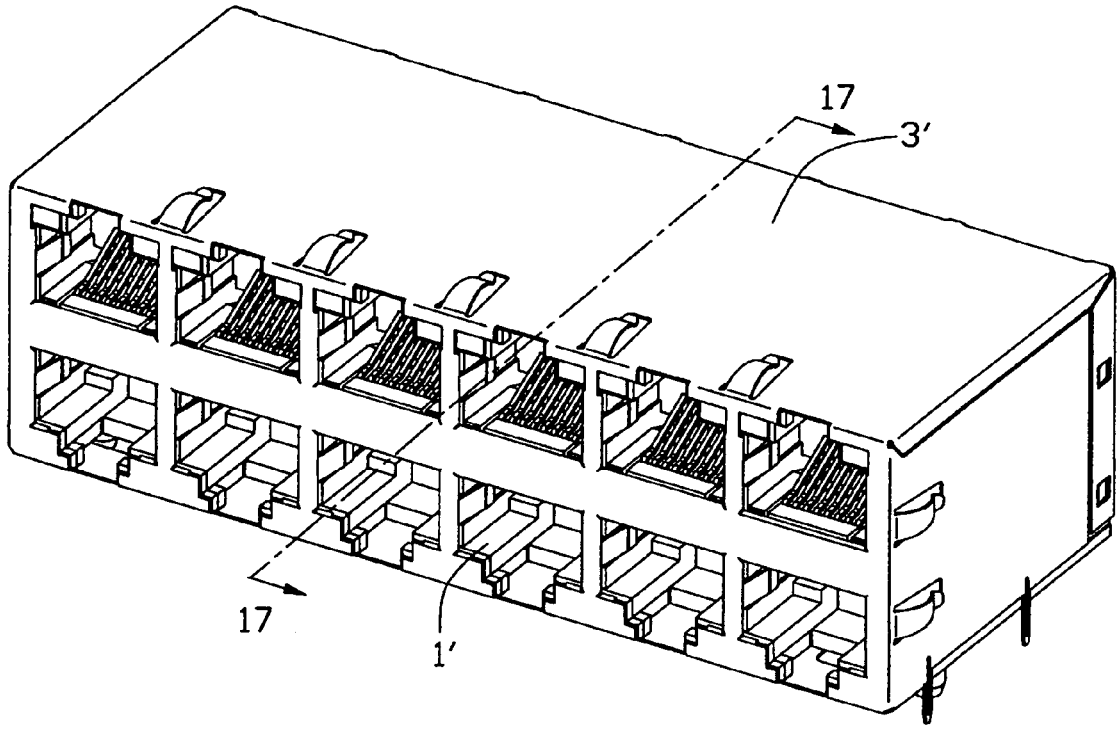
FIG. 15 is a perspective view of a second 2X6-port module connector according to the present invention.
Figure 16:
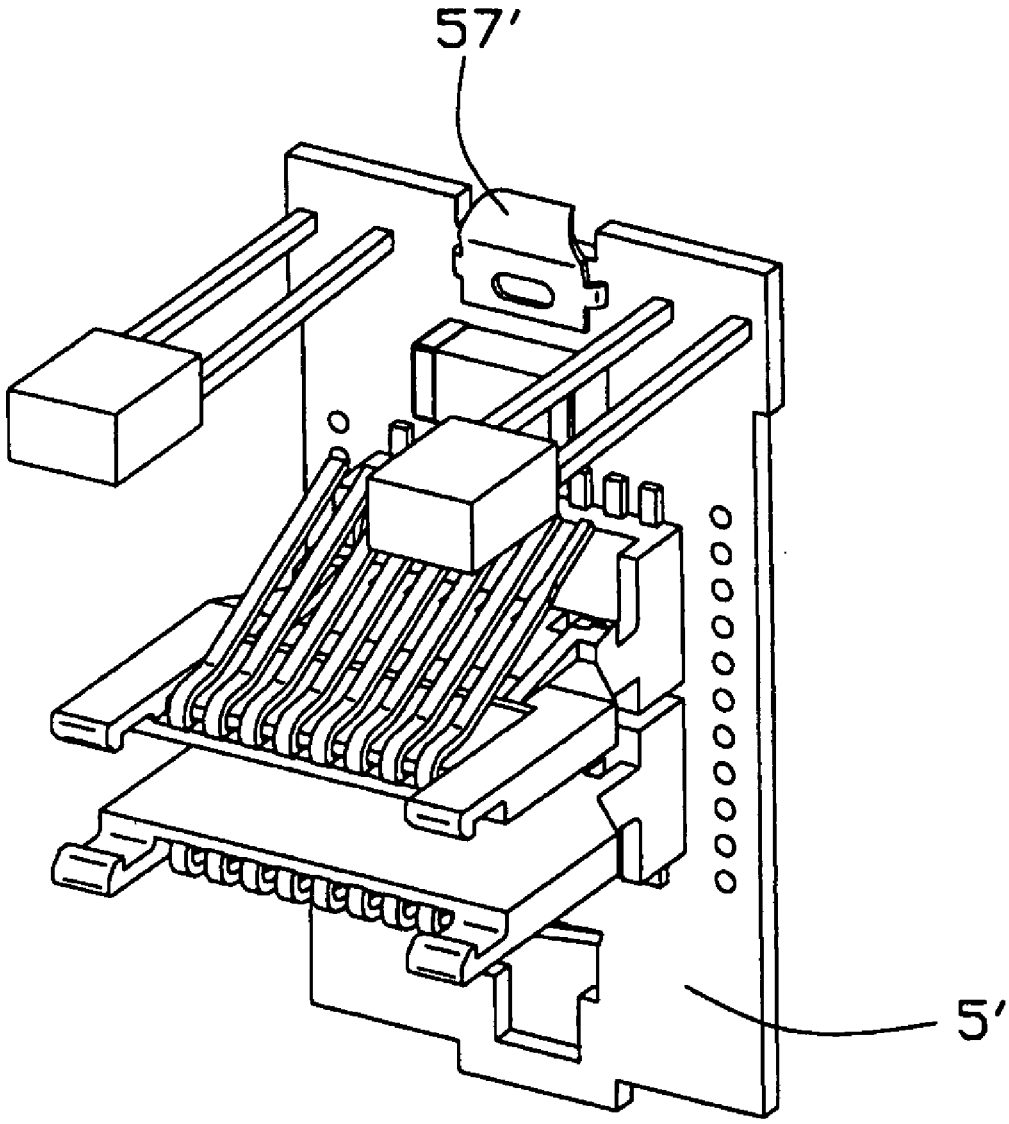
FIG. 16 is a perspective view of a front PCB module for making an electrical module received in the second 2X6-port module connector shown in FIG. 15.
Figure 17:
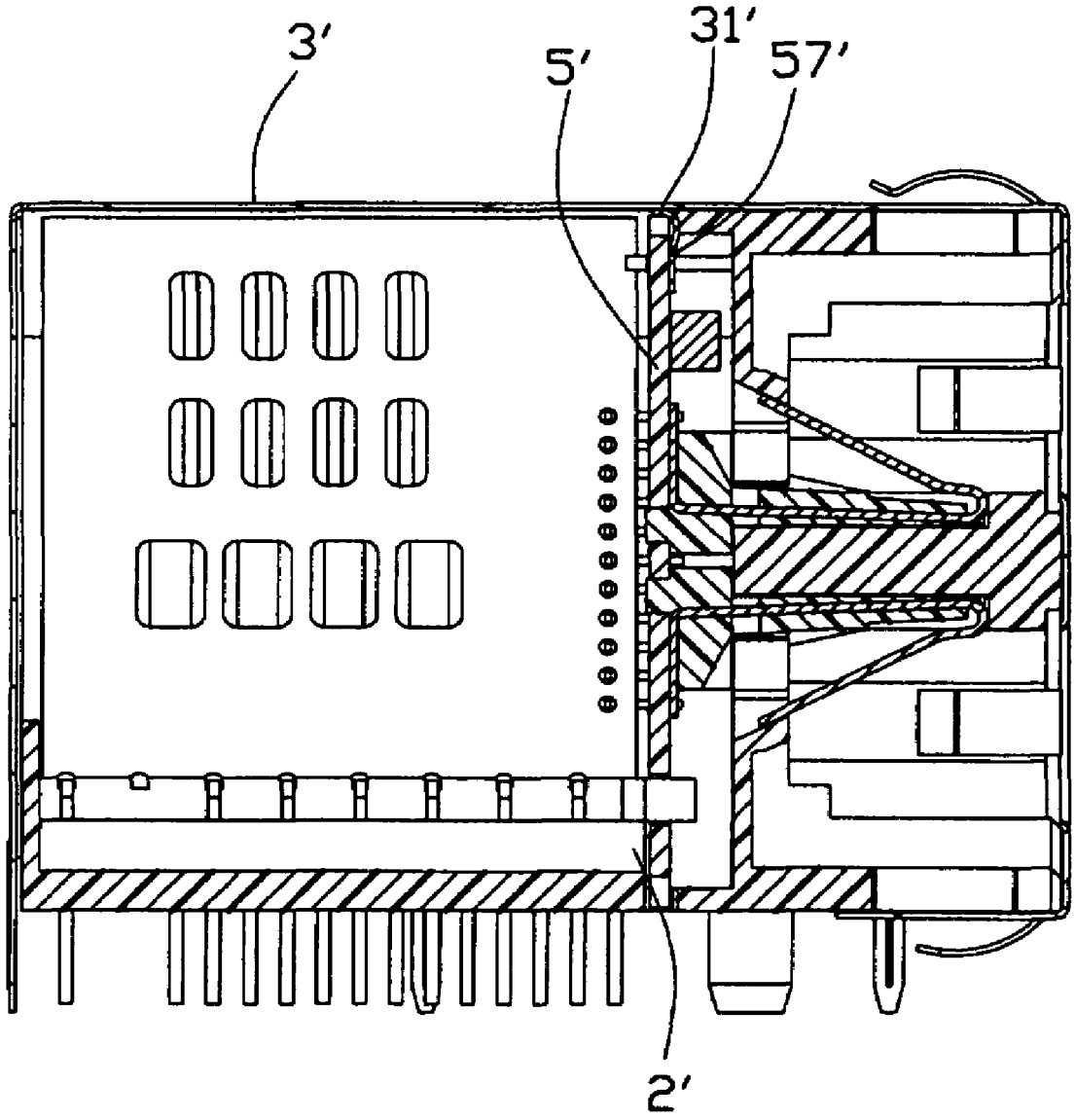
FIG. 17 is a cross view of the second 2X6-port module connector shown in FIG. 15 and taken along a line 17—17.

Reference to FIGS. 15–17, a second embodiment of the present invention is disclosed. In the second embodiment, each of the electrical module 2' further includes a grounding piece mounted on corresponding front PCB 5' and the shield 3' forms a flat top plane 31' corresponding to said grounding piece 57'. When the shield 3' is mounted over the housing 1', the grounding piece 57' abuts the flat top plane 31' of the shield 3' and so electrically connecting the electrical module 2' to the shield 3'.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

I claim:

1. A modular connector, used for electrically connecting modular plugs to a main PCB, comprising:

an insulative housing defining a vertical front mating face, at least one pair of vertically stacked cavities in said front face for receiving said module plugs therein, and at least one back space respectively communicating said at least one pair of stacked cavities;

at least one electrical module mounted in said at least one back space, each said electrical module comprising:

a vertical front PCB parallel to said front mating face, the front PCB defining a front side facing said cavities and a back side opposite to the first side;

two sets of mating contacts directly mechanically and electrically mounted on the front side of said front PCB and respectively extending into said cavities;

two parallel rear PCBs perpendicularly extending towards said front PCB and vertically mounted on the back side of the front PCB; and a plurality of terminals, each terminal forming a first pinhead connecting a corresponding rear PCB and a second pinhead for connecting the main PCB;

wherein said front and rear PCBs define a receiving slot therebetween and said electrical module further comprises a plurality of electrical components directly mounted on interior faces of said rear PCBs;

wherein said electrical module further comprises two sets of right-angled pins connecting said front PCB with respective rear PCB in through-hole soldering joints.

2. The modular connector according to claim 1 further comprising a shield covering the housing, and the shield further forms a spring cantilever inwardly to contact the front PCB.

3. The modular connector according to claim 1 further comprising a shield covering the housing, and wherein the electrical module comprises a grounding piece mounted on said front PCB and extending outwardly to contact the shield.

4. The modular connector according to claim 1, wherein the electrical module further comprises two first insulative bodies respectively securing said two sets of mating contacts.

5. The modular connector according to claim 4, wherein said first insulative body and said mating contacts are integrally insert-molded.

6. The modular connector according to claim 1, wherein the electrical module further comprises a second insulative body securing said terminals.

7. The modular connector according to claim 6, wherein the rear PCBs are vertically arranged and form two lower ends aligned in a horizontal direction, and the second insulative body has two opposite sides respectively abutting the interior faces of the rear PCBs near said lower ends.

8. The modular connector according to claim 7, wherein the second insulative body forms a plurality of guiding posts on either of said opposite sides of said second insulative body and the corresponding rear PCB defines a corresponding number of holes mating with said guiding posts.

9. The modular connector according to claim 7, wherein the second insulative body forms a rear wall abutting a rear edge of each of said rear PCBs.

10. The modular connector according to claim 9, wherein the second insulative body forms a front end abutting said front PCB and a pair of spring latches extending forwardly from said front end, and wherein the front PCB defines a through hole in alignment with said pair of spring latches, said pair of spring latches snapping into said through hole and attaching the second insulative body to the front PCB.

11. The modular connector according to claim 10, wherein a guiding board extending from the housing and sandwiched between said pair of spring latches.

12. The modular connector according to claim 11, wherein said front end of the second insulative body forms a pair of protrusions mating with a positioning tab extending from a lower edge of the front PCB.

13. The modular connector according to claim 1, wherein the electrical components comprise a plurality of magnetic coils.

14. The modular connector according to claim 13, wherein said electrical module further comprises a capacitor mounted on said front PCB.

15. A modular connector, used for electrically connecting modular plugs to a main PCB, comprising:

at least one electrical module, each said electrical module comprising:

a front PCB module comprising a front PCB defining a front side and a back side opposite to the front side;

two rear PCB modules, each rear PCB module comprising a rear PCB perpendicularly connecting to the back side of said front PCB to define a receiving slot therebetween;

a footer module disposed between said two rear PCBs and fastening the front PCB module and the rear PCB modules;

wherein a plurality of terminals directly mechanically and electrically connected to the front PCB and extending forwardly from the front side of the front PCB for mating with the modular plug, and each rear PCB is connected to a corresponding lateral side of the front PCB along a front edge region of said rear PCB.

16. The modular connector according to claim 15 further comprising an insulative housing defining at least one back space and said at least electrical module respectively received therein.

17. A modular connector, used for electrically connecting modular plugs to a main PCB, comprising:

at least one electrical module, each said electrical module comprising:

a front PCB module comprising a front PCB defining a front side and a back side opposite to the front side;

a rear module mounted on the back side of the front PCB, said rear module comprising two parallel rear PCBs, a footer module solder connecting to the parallel rear PCBs to define a receiving slot therebetween and a plurality of electrical components mounted on interior sides of the rear PCBs;

wherein a plurality of terminals directly mechanically and electrically connected to the front PCB and extending forwardly from the front side of the front PCB for mating with the modular plug, and a plurality of conductive elements are arranged along a front edge region of the respective rear PCB and electrically connected to the front PCB.

18. The modular connector according to claim 17, wherein the footer module includes a pair of spring latches extending forwardly and the front PCB defines a through hole in alignment with said pair of spring latches, said pair of spring latches snapping into said through hole and attaching the second insulative body to the front PCB.

19. The modular connector according to claim 18 further comprising a housing receiving said electrical module therein, a guiding board extending from the housing and sandwiched by said pair of spring latches.

* * * * *